United States Patent [19]

Burton

[11] 4,074,480

[45] Feb. 21, 1978

[54] KIT FOR CONVERTING SINGLE-GLAZED WINDOW TO DOUBLE-GLAZED WINDOW

[76] Inventor: Henry W. G. Burton, 161 St. James Place, Buffalo, N.Y. 14222

[21] Appl. No.: 657,376

[22] Filed: Feb. 12, 1976

[51] Int. Cl.[2] ..... E04B 1/66; E06B 7/12

[52] U.S. Cl. ..... 52/127; 52/172; 52/202; 52/304; 52/616; 428/34

[58] Field of Search ..... 52/171, 172, 304, 305, 52/616, 127, 173, 202; 428/34

[56] References Cited

U.S. PATENT DOCUMENTS

| | | | |
|---|---|---|---|
| 2,964,809 | 12/1960 | Gwyn et al. | 52/172 |
| 3,123,495 | 3/1964 | Carpenter et al. | 428/419 |
| 3,226,903 | 1/1966 | Lillethun | 52/616 |
| 3,234,699 | 2/1966 | Smith | 52/127 |
| 3,573,149 | 3/1971 | Tibble et al. | 52/616 |
| 3,866,380 | 2/1975 | Benson | 52/616 |
| 3,907,107 | 9/1975 | Vercollone | 428/419 |

*Primary Examiner*—James L. Ridgill, Jr.
*Attorney, Agent, or Firm*—Raymond F. Kramer

[57] ABSTRACT

A double-glazed window is readily made by installing onto an existing window a spacing frame containing a desiccant and joining a matching pane of glass to the spacer around the periphery thereof, thereby making an air tight seal about the air between the glass panes, with the desiccant in the spacing frame or in a portion thereof being communicable with the air between the panes so as to remove moisture from it to prevent undesirable condensation. The described double-glazed windows are readily installed by the homeowner, using a kit of materials for construction of the spacing frame and installation thereof. The kit includes spacing sides, previously cut to size for the particular window, having desiccant inside at least one of said sides, at least one opening in such a side containing desiccant, which opening faces the air volume when the frame is installed, sealing means for closing the opening during shipment and before use and sealant at ends of the tubular sides to prevent air leakage to the desiccant through such ends. Corner pieces are utilized to hold the sides together and preferably a corner piece is installed on each of the four sides to make the frame and is held in place by sealant, which also prevents air access to the desiccant through such end at which the corner piece is installed.

By means of the present invention the homeowner can measure his windows, order a kit including the requisite side pieces, at least one of which includes desiccant sealed off from contact with the atmosphere but with at least part of such a seal being removable upon installation, and sealant, and with these and preferably also with framing strips for decoratively and functionally framing the panes to be installed, can easily convert an ordinary window to a doble-glazed window.

Also described are the kit for making the double-glazed window, the method in which it is employed and the structure of the spacing member utilized.

5 Claims, 15 Drawing Figures

Fig. 1.
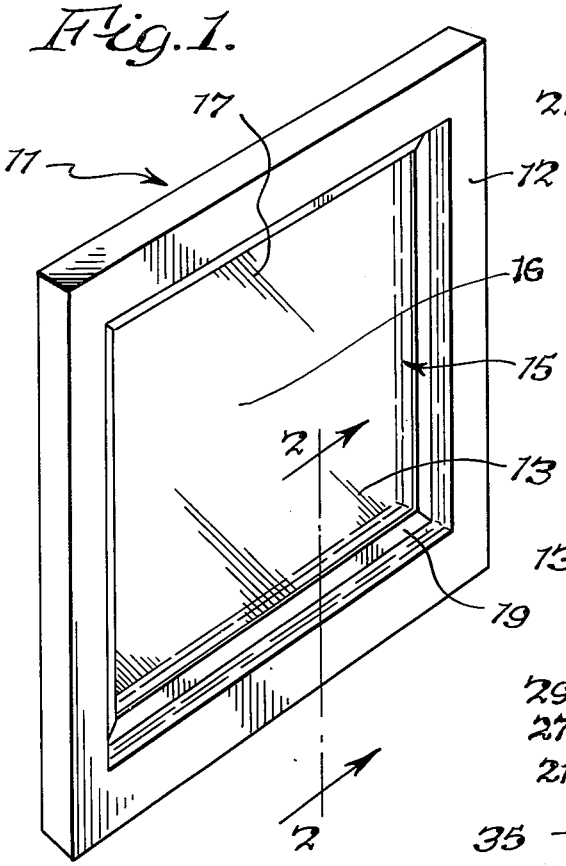
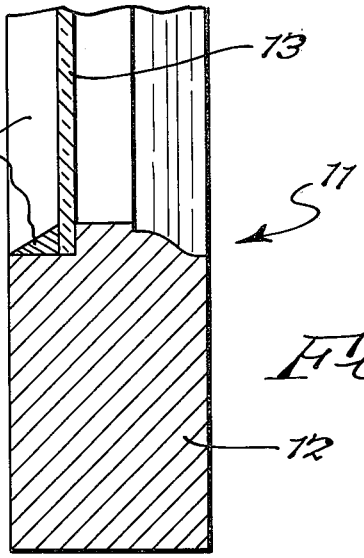
Fig. 3.
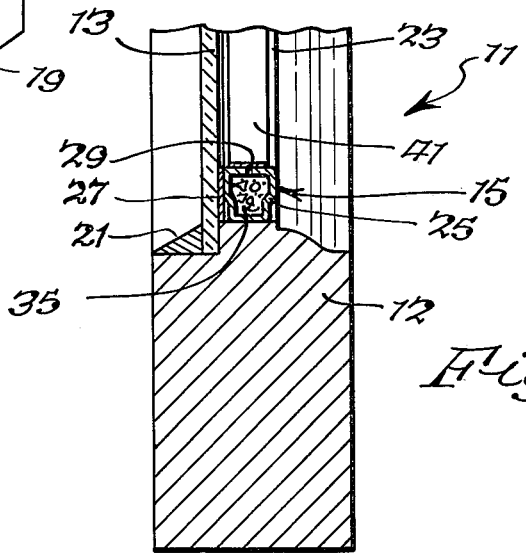
Fig. 4.
Fig. 2.
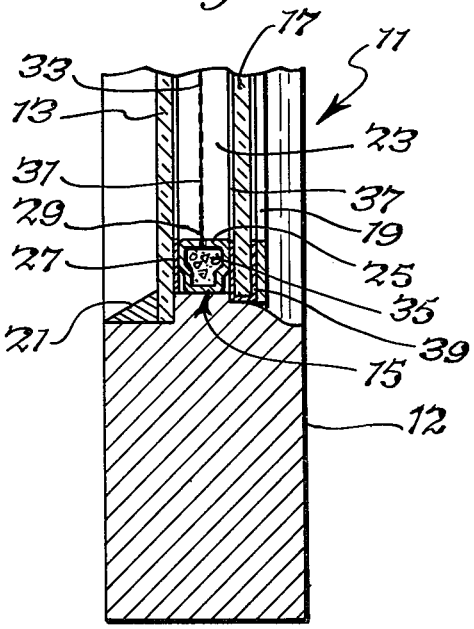
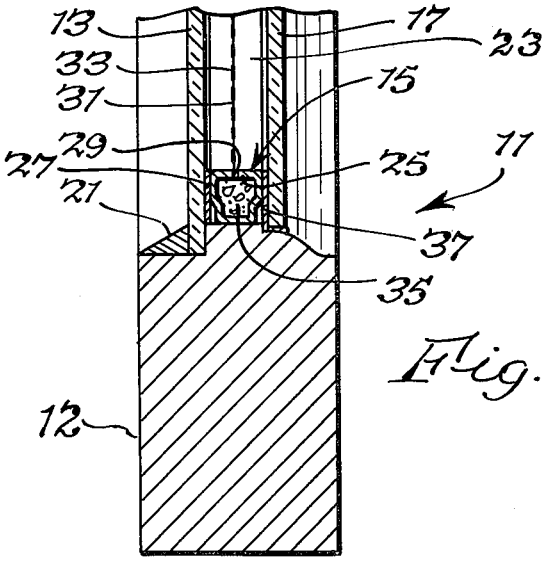
Fig. 5.

Fig. 9.
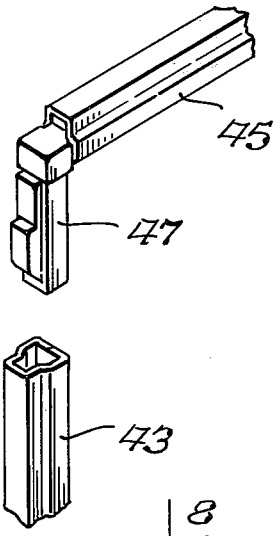
Fig. 6.
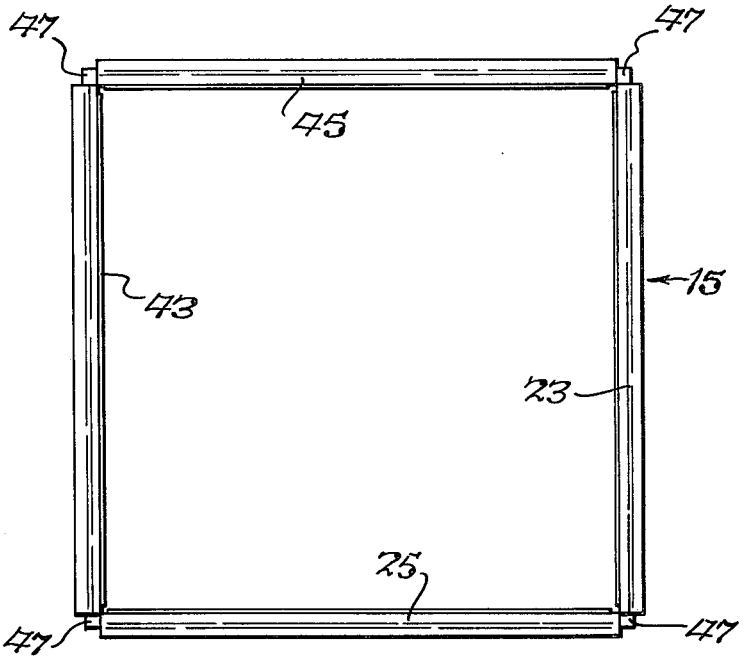
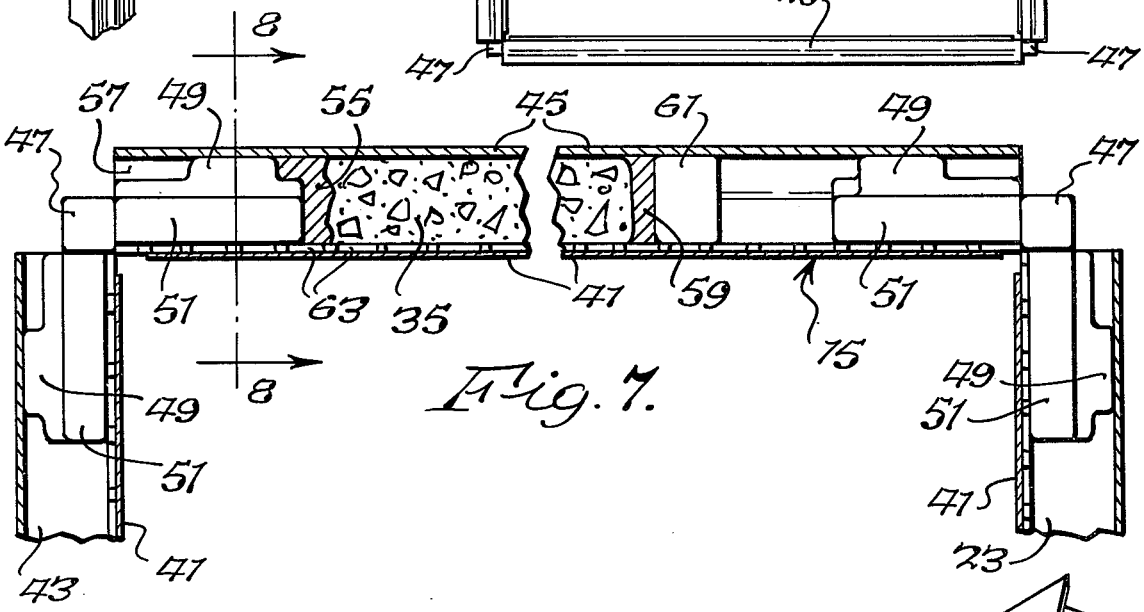
Fig. 7.
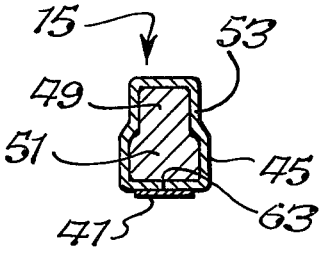
Fig. 8.
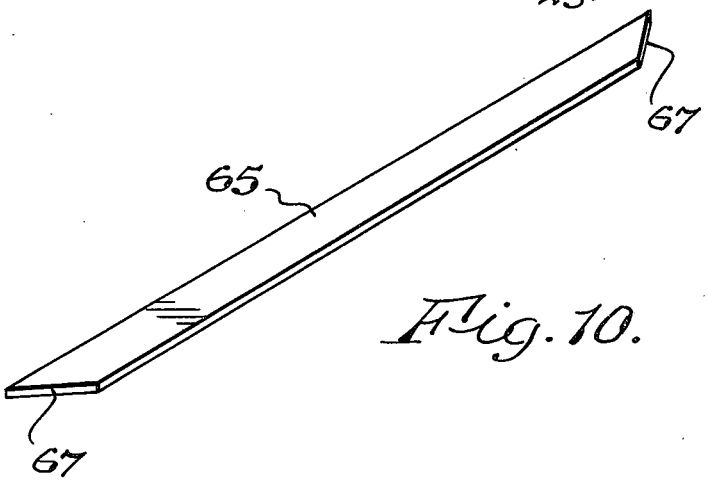
Fig. 10.

Fig. 15.
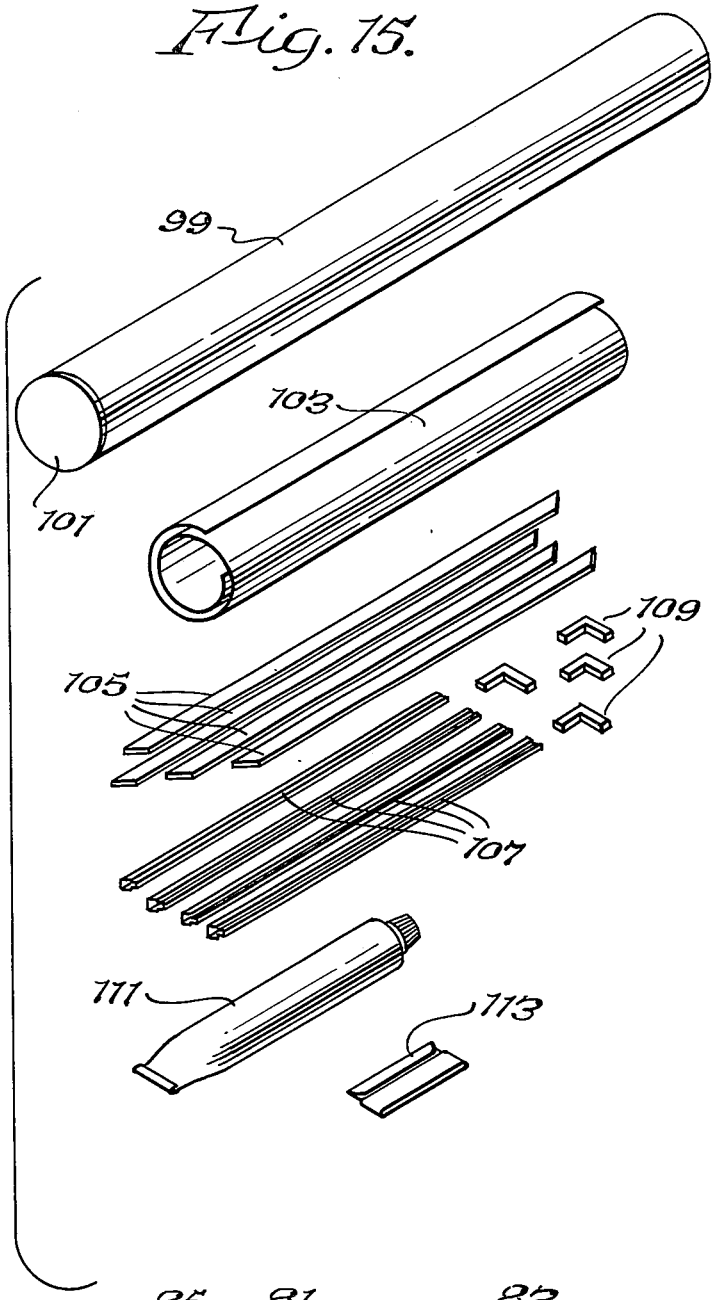
Fig. 11.
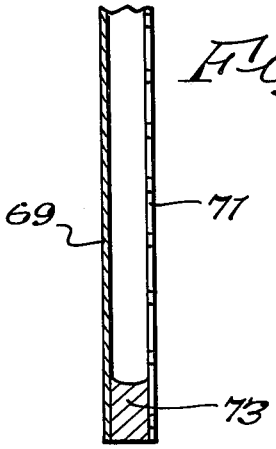
Fig. 12.
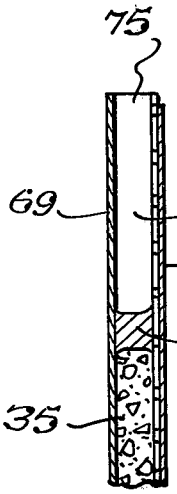
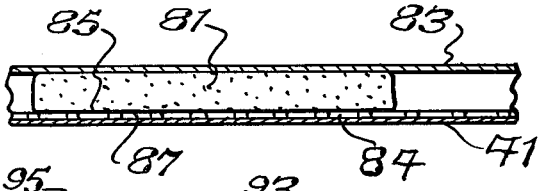
Fig. 13.
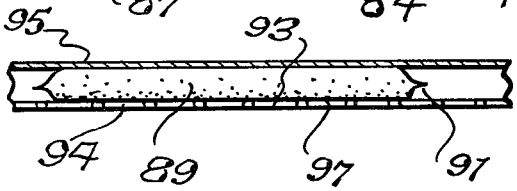
Fig. 14.

KIT FOR CONVERTING SINGLE-GLAZED WINDOW TO DOUBLE-GLAZED WINDOW

This invention relates to the conversion of single-glazed windows into multiple-glazed windows, especially to the conversion of ordinary installed window sash into double-glazed windows. More particularly, it relates to particular elongated spacing side members adapted to be assembled into a spacing frame utilized in the manufacture of the double-glazed window, methods for making such spacing members and for the manufacture of such windows and a kit of components useful in readily and easily converting such single-glazed window into a non-condensing double-glazed unit.

It has long been known that poorly insulated windows are a significant cause of wasteful heat transfer, resulting in the unnecessary consumption of additional energy to heat living and working spaces during cold weather and to cool such areas during hot weather. Especially at times of energy shortages and higher prices for gas, oil and electricity, increased attention has been directed to minimizing unnecessary thermal losses and the accompanying wastes of energy. In addition to providing adequate insulation in the walls of buildings and in spaces above the rooms thereof, such as attics and ceilings, and weatherstripping doors and windows, in many cases it is desirable for the windows to be double-glazed so as to minimize conduction of heat through them. However, for the conversion of already installed windows to non-condensing, double-glazed form no convenient, easy and readily practicable method or means have been provided whereby the homeowner himself can effect the conversion.

It is recognized that it is desirable to utilize a desiccant, preferably a concealed desiccant, in the air space between the two panes of glass (or suitable plastic) of the double-glazed windows and for this reason most of such windows are assembled at the factory, where the desiccant can be hermetically sealed inside them. However, this requires complete replacement of the existing window. In some cases, as described in U.S. Pat. No. 3,928,953 of Mazzoni et al., window units made for installation onto an already installed single-glazed window are shipped in hermetically sealed form for installation on site. However, such shipment of an assembled unit including glass involves hazards to the product during shipment and in storage before use.

The present method and kits for utilization in the practicing of the invented method provide simple and inexpensive processes and means for the homeowner to install a second glass at a desired spacing from an already installed window glass to produce a double-glazed window. The practice of this invention can be effected without the need for the homeowner or other installer to cut framing members or glass on site and the installation is carried out quickly and effectively to produce a functional and attractive product with little effort or skill being required of the installer.

In accordance with the present invention a method of converting a single-glazed window into a double-glazed window comprises: assembling a spacing frame from a plurality of elongated spacing side members of tubular shape, adapted to be assembled together at the ends thereof to form said spacing frame, at least one of said members having an opening in a wall communicating with the interior of such assembled frame, a desiccant inside said member, sealant in said member sealing off the desiccant therein so as to prevent contact between it and moisture in air except through the opening connected with the interior of the assembled frame, and readily removable or openable sealing means closing said opening; cementing the assembled frame in air tight contact to the glass of the single-glazed window about the periphery thereof; removing or opening the sealing means closing the opening in the spacing side member connected with the interior of the assembled frame; and cementing a pane of glass of substantially the same size as the glass in the single-glazed window to the sides of the spacing frame opposite those sealed to the glass of the original window, in air tight contact. Also within this invention is a kit of components for converting a single-glazed window into a double-glazed window which comprises a plurality of elongated spacing side members of tubular shape adapted to be assembled together at the ends thereof to form a spacing frame to fit about the periphery of the single-glazed window, at least one of said members having an opening in a wall thereof communicating with the interior of such assembled frame, a desiccant inside such member, sealant in said member sealing off the desiccant therein so as to prevent contact between it and moisture in air except through the opening connected with the interior of the assembled frame when said opening is not closed off, and readily removable or openable sealing means closing said opening. Near the heart of the invention is a particular spacing member, adapted to be assembled together with similar such members to form a spacing frame for use in converting a single-glazed window into a double-glazed window, which comprises an elongated, walled member having an opening in a wall thereof communicating with the interior of such assembled frame, a desiccant inside such member, and sealing means for sealing off the desiccant therein so as to prevent contact between it and moisture in air except through the opening in the wall thereof when a part of the sealing means adjacent said opening is removed or opened. Finally, the invention also relates to a method for manufacture of the described spacing members.

In preferred embodiments of the invention the spacing member is of elongated tubular structure, of straight sided cross-section (rectangular, square, stepped, tapered or other shapes are operative) having a seam in one of the sides thereof (usually down the center of the side), often with projections on the edges of the seam to produce or maintain spacings therebetween to permit air or moisture vapor flow through said side to the desiccant therein, the sealant means closing said openings before use is a pressure sensitive tape and each of said sides has a corner member held to it by sealant which also effectively prevents air and moisture vapor transmission through the end at which the corner member is installed. The kits preferably include cement or sealant and pieces of framing strip and in the practice of the installation method the second pane of glass is fastened in place within a very short time after exposure of the desiccant to air by removal of the pressure sensitive tape.

The invention will be readily understood after reference to the drawing and the detailed description in this specification, in which drawing:

FIG. 1 is a perspective view of a double-glazed window made according to the present invention;

FIG. 2 is a partial vertical sectional view taken along plane 2—2 of FIG. 1;

FIG. 3 is a partial vertical sectional view corresponding to that of FIG. 2, of the single-glazed window to be converted to a double-glazed window by the method and with the kit of this invention;

FIG. 4 is a partial vertical sectional view corresponding to that of FIG. 3 with a spacing frame of this invention installed on the single-glazed window thereof;

FIG. 5 is a partial vertical sectional view corresponding to FIG. 4 but with a sealing strip covering an opening in the lowermost tube of the frame of FIG. 4 having been removed and with a second pane of glass having been installed;

FIG. 6 is an elevation of a spacing frame of this invention;

FIG. 7 is a partial central vertical sectional view of the spacing frame of FIG. 6, showing the upper part thereof;

FIG. 8 is a vertical sectional view along plane 8—8 of FIG. 7;

FIG. 9 is a partial perspective view of a corner of the frame of FIG'S. 6 and 7 with the corner member held in place in one side of the frame and being adapted to be press fitted into an adjacent side of the frame to form a corner thereof;

FIG. 10 is a perspective view of a framing strip for decoratively framing the installed second pane of the double-glazed window;

FIG. 11 is a partial central vertical sectional view of a spacing side member of this invention having a plug in one end thereof, the lower end, to prevent access of air to the interior of the side member through such end;

FIG. 12 is a partial central vertical sectional view corresponding to that of FIG. 11, showing the top of the spacing side member with desiccant granules therein;

FIG. 13 is a partial central vertical sectional view of a side of the spacing frame, illustrating the employment of an aggregated desiccant therein;

FIG. 14 is a view corresponding to that of FIG. 13 but with a desiccant in an envelope being employed instead; and FIG. 15 is a disassembled view of a kit of this invention, as supplied to a homeowner for double-glazing installed single-glazed windows.

In FIG. 1 installed window sash 11, including a pane of window glass 13, is viewed from the interior side. Shown assembled and held to the window about the periphery thereof are a pre-assembled spacing frame 15, a second window pane 17 sealed to said spacing frame and decorative frame 19 sealed to pane 17. Between the panes 13 and 17 is hermetically sealed air space 16. The details of the construction of the double-glazed window of FIG. 1 are shown more clearly in FIG. 2.

In FIG. 2 window sash 11 includes window pane 13, held in place with respect to the window frame 12 by points, not illustrated, and covering putty 21 or similar mastic or plastic around the exterior periphery thereof. The window illustrated is to be considered as an entire window section, usually half of a complete window, but may also represent any part of a window or of such a section. For example, while one would normally utilize the present invention to double-glaze comparatively large window glass surfaces, such as those having dimensions between 0.5 and 1 meter or more, it may also be employed to double-glaze individual lights of windows, which, as when six lights or panes are present, as on the top half of a window, may be of dimensions in the range of 0.2 to 0.4 meter. In the illustrations, for the sake of simplicity, hardware, external window framing, counterbalance weight chains and window frame side notch structures are omitted. Spacing frame 15, of which component elongated spacing side members 23 and 25, of tubular shape and substantially straight sided cross-section are shown, is fastened to glass pane 13 around the periphery thereof by a continuous layer or deposit 27 of cement or sealant. Side member 25 has an opening 29 therein extending from one end thereof to the other, as does side member 23 have a similar opening 31. As illustrated, such opening is that created between the edges of tubularly shaped members 25 and 23, shown in stepped shape, although other straight sided shapes such as rectangular and square shapes and other suitable shapes are also useful. During manufacture of the tubing from a flat piece of stock, the opening is maintained by having small protuberances 33, resulting from crimping or handling the stock, projecting into the small clearance between the sides of the longitudinal opening. Of course, other means of creating the desired opening or openings in the side of the tubing facing the interior of the assembled frame may also be employed and other designs of openings may also be utilized providing that such allow communication between the entrapped air and the desiccant within the tube, such as desiccant 35. A layer of cement or sealant 37 about the periphery of the tubular frame holds the second window glass pane 17 and, as is illustrated, some of such sealant may also hold the boundary portions of such pane to the enclosing window sash frame 12. About the external periphery of the interior glass another layer of cement or sealant 39 holds in place decorative framing member 19. Instead of cement or other such liquid or plastic sealant self-adhering tape, preferably of a cushioning type may be used, e.g., polyurethane foam "carpet" tape, but the liquid or plastic sealant is usually preferred.

In FIG'S. 3–5 are shown steps in the construction of the finished product of FIG'S. 1 and 2. In FIG. 3 is shown the single-glazed window before installation of any parts of the present invention. In FIG. 4 spacing frame 15 has been installed, comprising spacing side members 23 and 25 and desiccant 35, with the interior side openings 29 being covered by pressure-sensitive tape 41. Not illustrated in FIG'S. 2, 4 and 5 are corner members and sealants to prevent contact of the desiccant with air through the ends of the side members. However, such are shown clearly in FIG. 9.

In FIG. 5 is illustrated the product of the invention wherein the second pane has been installed and the hermetically sealed air space between the panes is in communication with desiccant 35. However, decorative (and functional) framing member 19 has not yet been applied.

FIG. 6 shows an assembly of elongated spacing side members, forming a spacing frame. Side members 23, 25, 43 and 45, which are held together by press-fit corner members 47 and also ultimately are held together by being sealed in position between glass panes 13 and 17, form spacing frame 15. In FIG. 7 internal details of the elements of spacing frame 15 are illustrated. Tubular elongated spacing side members 43, 45 and 23 are shown held together by corner members 47, press-fitted into the tubes at the corners thereof. Corner members 47 are L-shaped and have dimensions which allow them to be press-fitted into the correspondingly shaped stepped tubular members. Thus, projection 49 on body portion 51 of corner member 47 mates with the interior of a step-down portion 53 of tube 45, as will be readily seen in FIG. 8. Around corner 47 is sealant 55 which helps to hold the corner member in position in tube 45 but more importantly, forms a hermetic seal between the interior of tube 45 and desiccant 35 therein and the air at the open end 57 of tube 45. Cement or sealant 59 hermetically seals the other end of tube 45 and in the illustration optional plug 61 backs the sealant. In shipment of the tubular side members to the ultimate user it is desirable that corner member 47 be in final position in tube 45 and in any other such tubes supplied which may contain desiccant but in the event that it is not in such position sealant 55 can still satisfactorily protect desiccant 45 but in such case the desiccant and the sealant will usually be moved further toward the middle of tube 45 so as to allow room for insertion of corner member 47 without causing obstruction thereof by the sealant. If a plastic sealant is employed, which will deform upon contact with the corner member being inserted without breaking the hermetic seal about the desiccant, the desiccant and sealant may be located as illustrated so as to be in intimate and sealing contact with the corner member upon insertion thereof. For convenience of illustration in FIG. 7 an upper tube 45 is shown to include the desiccant. Usually, if only one such tube contains desiccant it will be a lower or lowermost tube but several or all of the four elongated spacing tubular side members may each contain the desiccant and the associated seals (and preferably one corner member) to protect the desiccant during shipment or storage of the spacing side members.

A cross-section of the straight sided, stepped tubular member of FIG. 7 is shown in FIG. 8 with pressure sensitive tape 41 in place sealing off openings 63 before final installation of the second pane of glass. A perspective view of corner member 47 in tube 45 before joining of tubes 45 and 43 is shown in FIG. 9. One of the four decorative framing strips 65 of frame 19 is shown in FIG. 10. Such strips are mitered at ends 67 so as to be attractively fitted together.

FIG'S. 11 and 12 are illustrative of steps in the process of manufacturing the tubular side spacing members of this invention. In FIG. 11 tube 69, with openings 71 therein, is shown with a soft wax, mastic, plastic or silicone rubber sealant 73 filling one end thereof. Such product is producible by dipping tube 69 into a mass of the material of hermetic seal 73. At this stage opening 71 in the interior side of tube 69 is not sealed with pressure sensitive tape. Subsequently, mass 73 may be pushed inwardly by means of a ram, shaped to conform with the interior of the tube, or may be pushed inwardly by a conforming corner member which it then helps to hold in position while creating a hermetic seal. In FIG. 12 tube 69 is shown with desiccant 35 having been added thereto through open end 75 after pressure sensitive tape 41 has been placed in position sealing off openings 71. Sealant 77 is then placed atop the desiccant before the desiccant may be sifted to a smaller volume. This allows room for expansion of the desiccant as it takes up moisture and prevents the possibility of any such expansion distorting tube 69. A space 79 is left above sealant 77 for insertion of another corner member from another side member or for insertion of a separate corner member to join another side member to the illustrated one. Although, as illustrated, tape 41 is applied after sealant 73, in some embodiments of the invention it will be continuously applied to the tubing over the openings in it, often covering about ⅛ to ½ the tubing width, even before such tubing is cut to size and sometimes may be rolled up with the tubing to form rolls thereof for easier storage before cutting and use.

In FIG'S. 13 and 14 there are shown variations of the desiccant, with the granular or particulate desiccant previously illustrated being replaced by unitary desiccant material. In FIG. 13 the granular desiccant is agglomerated or otherwise produced in unitary form, as by cementing together particles of the desiccant while still leaving much of the surfaces of such particles uncovered by cement so that the particles are still effective as a desiccant. Agglomerated particulate desiccant mass 81 is held in position in tube 83 by being cemented to a wall portion 85 of perforated tube 83 by cement 87, with openings 84 being covered by tape 41. In FIG. 14 is shown desiccant 89 in flexible, hermetically sealed container 91 held to a wall portion 93 of tube 95 by adhesive 97. The adhesive illustrated is a two-faced pressure sensitive tape. With container 91 hermetically sealing off desiccant 89 it is unnecessary to have pressure sensitive adhesive tape sealing off openings, designated 94, in the side wall of tube 95. To make the desiccant accessible to the humidity in air entrapped between the two panes of glass in the double-glazed window, before completion of construction thereof container 91 should be perforated, as by passing a pin or other sharp implement through openings in the tube wall. Alternatively, container 91 may be of desiccant-holding material which is perforated sufficiently to allow the passage of air through it, in which case a readily removable pressure sensitive tape should be utilized on the exterior of the tube to prevent loss of desiccant activity before use.

A kit of the components utilized to convert a single-glazed window into a double-glazed window is illustrated in FIG. 15, in disassembled form. As supplied, all the parts thereof will be inside shipping tube 99 or equivalent container which is preferably closed at the ends thereof by friction fit closure caps or inserts 101. The container is preferably made of moisture transmission-resistant or barrier materials to limit access of moisture to the enclosed spacing side members which contain desiccant. Instructions 103 for installation of the enclosed parts and formation of a double-glazed window with a piece of glass cut to size are enclosed in container 99, as are external decorative frame strips 105, elongated tubular spacing side members 107, corner members 109, separate, as illustrated, or preferably one each at appropriate fitting ends of the spacing side members 107, a tube 111 of sealant, preferably silicone rubber sealant and a razor blade 113 for removing excess deposited sealant from the glass and the spacing side members. As is seen, the various components of the double-glazed window assembly, except for the second pane of glass, are of small volume, easily shipped and require only another piece of glass substantially matching that already in the window to allow the householder to produce a double-glazed window. Of course, in some kits a multiplicity of the various parts will be enclosed to facilitate double-glazing of a plurality of windows or panes of a window.

The manufacture and use of the various aspects of this invention are simple, straightforward and readily practicable. The materials employed are available, the various parts of the described kit are simply produced and installation of the second window to form the double-glazed window is simple and trouble-free. Tubing for use as the sides of the spacing frame is available or if desired can be easily manufactured. It is produced by shaping a strip of metal over forming dies to the desired shape, preferably straight sided, such as the stepped shape illustrated, but rectangular and squarish shapes are also employed and even tubes of round or elliptical cross-section can be utilized, although not as easily. The formation of an open seam where the sides of the formed tube meet is a simple manufacturing step and the inclusion of a number of projections on said sides is readily effected, as by controllably crimping them, so as to maintain the opening. The tubing may be produced in straight or rolled forms and comparatively great lengths thereof may be rolled onto large reels and then straightened and cut to length as they are used. Alternatively, a similar product may be molded of synthetic plastic. Of course, instead of using openings of the type described such openings may be drilled, stamped or molded into the appropriate locations on the "interior" wall of the spacing side members.

The corner members may be readily formed by a variety of molding processes. Preferably they are thermoplastics but other synthetic organic plastics of the thermosetting type may be employed, as may be metals and natural products, e.g., rubber, other elastomers, hard rubber. Spring wire or hollow corner members may be utilized instead of the solid embodiments illustrated. In some cases, instead of the corner members being cemented or sealed into place in the tubing they may be softened slightly and forced into position so that the polymer of the member itself acts as the sealant against the inner wall of the tubing.

Provision of a seal inside the spacing side member, sealing off the openings in the side wall thereof with pressure sensitive adhesive, filling the desiccant and sealing it in place are readily practiced operations. Usually it is preferred to have the openings in the side wall sealed before insertion of the desiccant. The desiccant will normally be sized so that it will not be able to pass through the openings in the tube side wall. However, to allow for the presence of undersized particles of desiccant the presence of tacky or plastic adhesive or sealant in the tube is desirable since very small particles of desiccant will preferentially adhere to such and will not be able to pass through the wall openings.

After production of the desiccant-containing spacing side members, with or without a corner member inserted in each, such members may be cut to desired length, as ordered. However, it is normally preferred to fill orders by cutting the lengths requested and subsequently filling with desiccant, etc. In a similar manner, the mitered decorative framing pieces may be cut. Then the pieces that will be required (except for the glass) to make the desired spacing assembly and decorative frame of the correct size, as ordered, will be shipped with instructions, sealant, razor blade and any other optional material desired. The homeowner needs then only to obtain the glass of the correct size and proceed with the installation according to the instructions.

In such installation the spacing frame, to separate the original pane of glass in the installed window from the new pane, is assembled and is cemented or sealed into place, preferably using a silicone rubber adhesive which cures at room temperature, usually desirably absorbing moisture in its cure. After approximately 24 hours the frame will be firmly adhered to the original pane and any surplus adhesive may be removed from it and the pane, as by scraping with the razor blade, after which the surface may be cleaned and dried. A coating of the silicone rubber adhesive or other sealant may then be applied to the face of the separating assembly facing outward (against which the second piece of glass will be sealed), the adhesive tape may be removed from the wall of at least one of the sides of the spacing unit and the new pane of glass may be placed in position on the frame, trapping any air between the two panes permanently as in conventional dual-glazed windows. Curing of the adhesive helps to remove some moisture from the air and additional moisture is removed by the desiccant. Also, in cases where the adhesive or the other elements of the assembly contain moisture, whether apparent, occluded, as water of hydration or crystallization, absorbed or adsorbed, the desiccant will often effectively remove it too. Finally, to insure complete sealing and to improve the appearance of the window a further coating of adhesive is applied on the outer periphery of the installed pane of glass and the decorative framing is pressed against it, completing the operation. In approximately 24 hours, sometimes a day or so more, the adhesive will be in its final set and the hermetic seal will thereafter be maintained. In the event that the side members or framing members are slightly too long, possibly due to incorrect initial measurement before ordering, they may be cut to the correct length with a hacksaw or similar tool before assembly with the corner members. If slightly too short they may be installed with little disadvantage since the difference in length will often be difficult to note and if desired, the opening may be filled with appropriate caulking compound, putty or other plastic material.

The component parts and materials utilized in making the spacers and kits of this invention and in the installation of the double-glazed windows are chosen to be suitable for the particular job being done. For example, if the double-glazed window is being installed outside, rather than inside the already installed pane, different, heavier and more weatherproof materials may be utilized. However, normally the tubing, if of aluminum or aluminum-magnesium alloy, will be of a thickness of 0.3 to 1.5 mm. preferably about 0.4 to 0.8 mm. The frame will normally be about 0.5 to 1.5 cm. wide but the width of entrapped air will be slightly greater, due to the additional layers of cement or sealant between the glass and the frame. Generally, the other cross-sectional measurement of the frame will be about ½ to twice the mentioned width. Approximately the same dimensions apply when plastic tubing is utilized. The opening or seam on the inner face of the spacing member will usually be of a width in the range of 0.05 to 0.2 mm., preferably about 0.1 mm. The desiccant may be any suitable size larger than the mentioned opening but the particle size (diameter) will normally be in the range of 0.5 to 3 mm. for granular material, preferably 1 to 2 mm. The sealing tape will generally be of a thickness, including the adhesive thereon, of 0.05 to 0.3 mm., preferably about 0.1 mm. The thickness of sealant to hold the frame to the glass panes and to hold the decorative framing pieces to the glass will usually be the minimums possible, e.g., 0.1 to 0.4 mm. The thicknesses of sealant in the spacing tube to prevent air contact with the desiccant through the ends of such tubes will often be in the range of 5 mm. to 2 cm. The decorative framing members will usually be from 1 to 2 mm. thick and will be wide enough so as to cover the installed spacing member, usually being about 0.5 to 1.5 cm., e.g., 1 cm. wide. Although the dimensions given are useful as guides it will be realized that with modifications of designs of the various components they are subject to change.

The materials of construction which may be employed are any that are suitable for the various purposes of the invention. Thus, while aluminum and aluminum-magnesium alloy "tubing" and decorative framing pieces are often preferable, in any of polished, brush-finished, anodized or enameled finishes, often with colors to match the window frames, one may also utilize synthetic organic polymeric materials, such as polyvinyl chloride, polypropylene, nylon, ABS, styrene, polyesters and the various "engineering plastics" for the tube and decorative framing member constructions. The moldable plastics allow for molding in of at least one "plug" in place of sealant to protect the desiccant in the tube.

The desiccant employed is most preferably of high moisture sorbing capacity, e.g., 10 to 25% of its weight, but useful products can be made when such moisture sorbing capacity is as low as 2% by weight providing that more of the desiccant is employed. Thus, whereas molecular sieve zeolite beads such as Molsiv$^{TM}$ adsorbent, sold by Union Carbide Corporation, is a preferred desiccant, other molecular sieves, mixtures of molecular sieves, silica gels and suitable desiccants may also be employed. Still, it is preferred to use the molecular sieve zeolites, e.g., Type 4A sodium aluminosilicates, which have a higher moisture sorbing capability. The molecular sieve zeolites have been referred to in this specification as desiccants but they are also useful to sorb solvent vapors, such as may be present from cements or sealants employed in the assembly of double-glazed windows. While the amount of desiccant utilized depends on its sorptive properties, normally from about 1 to 50 grams of desiccant will be employed, e.g., 5 grams of molecular sieve zeolite, per window installation. Of course, for a particular job, the desired number of desiccant-filled spacing sides will be utilized to furnish the required or optimum drying capability.

The sealant employed is preferably a silicone rubber or polysulfide but various other sealants based on elastomeric materials may also be utilized, such as those based on butyl or natural rubbers, so long as they will produce tight bonds and moistureproof barriers. The conventional sealants of the art, usually employed in the factory manufacture of double-glazed windows, are satisfactory. The pressure-sensitive adhesive on the tape may be any suitable such material and normally, for coating paper, cloth or plastic backing members such as those made of glassine, Mylar®, cellulose acetate, polyethylene, cellophane or other polymeric material, will be in the form of an elastomeric mass coat such as a latex or solvent cement based on natural or butyl rubber of a sufficient tack to satisfactorily hold to the substrate, e.g., aluminum, to which it is applied. The thickness of adhesive on the backing material for the pressure sensitive adhesive will normally be about the same as the thickness of the backer, about 0.03 to 1.5 mm., usually about 0.5 mm. The width of the tape can be relatively small, e.g., 0.3 to 0.7 cm.

The corner members for the spacing frame may be made of any suitable material but molded synthetic organic polymers are best, e.g., nylon, polymethyl methacrylate, phenol formaldehyde condensates, hard rubber, polystyrene, ABS, whether solid or hollow. Elastomeric materials such as butyl rubber and neoprene are also useful.

The advantages of the present invention are many. Following directions obtained from the manufacturer of the present kits and parts thereof the homeowner may measure the windows he desires to double-glaze and send such measurements with his order to the manufacturer. At the factory various parts that have been precut for the most popular sizes of windows will be selected and shipped, preferably by a parcel delivery service or direct mail, to the purchaser, with instructions for installation. In some cases the parts will be cut to order in the factory and the desiccant will be inserted and sealed in the appropriate part or parts shortly before shipping. Because the tube interior is hermetically sealed the desiccant is maintained dry and active until ready for use. The homeowner has meanwhile purchased an appropriate size of glass for double-glazing his window and will be ready to effect installation in the manner previously described. Care will be exercised in the installation to clean all the parts employed, especially removing the excess sealant from the glass and spacers. The exposure of the opened spacer and contained desiccant to air should be very limited, with the time of exposure being no more than 15 minutes in most cases, preferably less than 5 minutes and most preferably being less than a minute or two before the second pane is installed and sealed in place, trapping the confined air between the glass panes. In many instances it will be unnecessary to hold the second glass against the spacing frame while the adhesive is curing but if such holding is desirable it is readily effected mechanically. Alternatively, if the sash can be removed during installation of the second pane of glass the sealing of it to the spacing frame can be effected in a horizontal position, with the weight of the glass or additional weights thereon helping to maintain good contact with the sealant.

Because the pane of glass does not have to be shipped with the components of the present kits shipping and insurance costs are much reduced and the danger of breakage is obviated. The cost of the installation is lowered accordingly and also because the installer does not have to pay for factory labor and overhead in assembling the double-glazing parts. Furthermore, should such an installed window be broken or should condensate form on it it may be repaired or parts of it may be replaced with less difficulty than would be encountered utilizing factory assembled structures.

Although preferred embodiments of the invention have been described various modifications of these may be made and are within it. For example, a decorative framing assembly may also be installed on the exterior of the original window to improve the appearance thereof. Alternatively, an aluminum colored cement may be utilized to hold the spacing members to the first glass and will thereby conceal the corner members, improving the appearance of the assembly. When plastic spacing elements are utilized plugs or corner pieces may be molded to one end thereof.

Instead of utilizing pressure sensitive or self-adhesive tape to close the opening in the wall of the spacing member other means of sealing this may be utilized such as collodion or other strippable cement, moistureproof shrink wrap or other suitable moistureproof wrapping, very preferably tightly clinging to the spacer so as to exclude as much air as possible. However, such wraps have the disadvantage of exposing the opening in the side wall of the spacer as soon as the spacer is being applied to the first pane, rather than when the second pane is being readied for application. Still, with quick assembly of the entire unit their use may be feasible. Alternatively, the inner wall (facing the entrapped air between the glass panes) of the spacing member may be very thin in part so as to be readily openable or puncturable to give the desiccant access to such air space or a strippable part of said wall may be removed (as is done with beer or sardine cans) before installation of the second pane of glass. A strip of thermoplastic material may be fused to the spacing wall to cover the opening therein by the application of heat and may be removed before use. However it is much preferred to employ the pressure sensitive adhesive coated tape, which is readily available, easy to apply, inexpensive and easy to remove without leaving undesirable residue on the spacing member wall.

The cylindrical tube container for the kit parts may be replaced by a conventional corrugated board or other suitable rectangular box designed to efficiently hold the various components of the kit in position during shipment. Such cartons may be made longer than some kit tubes and may be cut to lengths to fit them.

Although the invention is designed to be employed primarily with rectangular windows it is also useful for double-glazing other shapes of openings, preferably straight walled, but even including curved windows, e.g., circular windows, when the parts are shaped accordingly. Also, while glass is the usual glazing material employed transparent plastics can also be used.

The invention has been described with respect to various embodiments and illustrations thereof but is not to be limited to these because it is evident that one of skill in the art, with the present description before him, will be able to utilize equivalents and substitutes without departing from the spirit of the invention.

I claim:

1. A kit of components for converting a single-glazed window into a double-glazed window which comprises a plurality of elongated spacing side members of tubular shape adapted to be assembled together at the ends thereof to form a spacing frame to fit about the periphery of the single-glazed window, at least one of said members having an opening in a wall communicating with the interior of such assembled frame, a desiccant inside such member, sealant in said member sealing off the desiccant therein so as to prevent contact between it and moisture in air except through the opening communicating with the interior of the assembled frame when said opening is not closed off, and readily removable tape sealing means closing off said opening.

2. A kit according to claim 1 wherein the desiccant is a molecular sieve zeolite and which kit contains a container of polysulfide rubber cement or sealant for holding the spacing frame in place against the window onto which it is installed and for holding window glass being installed to the spacing frame in air tight and moisture vapor tight assembly.

3. A kit according to claim 1 wherein the plurality of tubular spacing side members is four such members, which are of substantially straight sided cross-section, at least one of which has an opening or a plurality of openings in a side thereof which faces the interior of the assembled frame, which frame is of rectangular shape, the desiccant is of such characteristics that it does not pass through said opening(s), and the readily removable tape sealing means closing the openings in said member is a strip of pressure sensitive adhesive tape, and which kit includes four corner members adapted to be inserted into the tubes and to hold them together as a frame to facilitate installation.

4. A kit according to claim 3 wherein the sides of the spacing side members are of the same construction, with opposite pairs of said members, when installed, being of substantially the same dimensions, and with at least one thereof having a plurality of openings in a seam in a side thereof facing the interior of the frame, when assembled, the desiccant is in granular form and of such size as not to be passable through opening(s) in the seam in the spacing side member in which it is contained, the corner members are of such size and shape as to be fitted into the spacing side members, a corner member is present inserted into each of the spacing side members and sealant in such a member seals off desiccant therein except for the openings in the interior side seam by sealing off the spaces between the corner members and the spacing side members into which they are inserted.

5. A kit according to claim 4 which includes a framing strip or a plurality of said strips for framing window glass installed against the spacing frame, and a container of a polysulfide rubber cement or sealant for holding the spacing frame in place against the window onto which it is installed, holding window glass being installed to the spacing frame and holding the external framing strips to said glass, in air tight and moisture vapor tight assembly, and wherein the spacing side member containing desiccant contains molecular sieve zeolite desiccant.

* * * * *